United States Patent [19]

Baumann et al.

[11] 4,249,579

[45] Feb. 10, 1981

[54] SHAFT FOR A WEAVING MACHINE

[75] Inventors: Hans Baumann, Horgen, Switzerland; Hartmann Bader, Bad Liebenzell, Fed. Rep. of Germany

[73] Assignee: Sulzer Brothers Limited, Winterthur, Switzerland

[21] Appl. No.: 9,493

[22] Filed: Feb. 5, 1979

[30] Foreign Application Priority Data

Feb. 7, 1978 [CH] Switzerland ..... 1340/78

[51] Int. Cl.[3] ..... D03C 9/06

[52] U.S. Cl. ..... 139/92; 403/13

[58] Field of Search ..... 139/57, 58, 82, 91, 139/92; 403/13, 14

[56] References Cited

U.S. PATENT DOCUMENTS 3,085,597 4/1963 Dolbeare ..... 139/58

4,112,980 9/1978 Bader ..... 139/92

*Primary Examiner*—Henry Jaudon

*Attorney, Agent, or Firm*—Kenyon & Kenyon

[57] ABSTRACT

A resilient drive-transmitting intermediate element is provided between the retaining element and the shaft is rotatably mounted in a bore in the shaft and has an adjusting eccentric member which is engaged in an aperture in the retaining element. The resilient intermediate element comprises an inner member of substantially the same diameter as the bore and an outer eccentric ring shaped member so mounted on the inner member to rotate therewith. The outer eccentric ring shaped member can be introduced together with the retaining element into the shaft and the inner member can be introduced through and retained in the bore. Rotation of the complete intermediate element adjusts the retaining element relative to the shaft.

15 Claims, 8 Drawing Figures

SHAFT FOR A WEAVING MACHINE

This invention relates to a shaft for a weaving machine. More particularly, this invention relates to an element for securing a retaining element in a shaft of a weaving machine.

As is known, weaving machines are frequently provided with a shaft from which various elements, such as a cross-strut or heddle lath, can be supported in a suspended manner by a retaining element. In such cases, the retaining element is fitted into the interior of the shaft so as to extend from the shaft. In order to secure the retaining element in place, a resilient intermediate drive transmitting element is usually disposed between the retaining element and the shaft. In addition, in order to provide for an adjustment, the drive transmitting element can be rotatably mounted in a bore of the shaft with an adjusting eccentric engaged in an aperture of the retaining element. As described in German application No. P27 11 182, filed Mar. 15, 1977 and laid open on Aug. 17, 1978 as well as in U.S. Pat. No. 4,112,980 the intermediate element and eccentric are made integral with each other. However, since the intermediate element must be introduced through the bore into the shaft, the extent to which the eccentric can be larger than the bore is limited. For the same reason, the intermediate element must be made of a material which is relatively resilient. As a result, the intermediate element has relatively little dimensional rigidity.

Accordingly, it is an object of the invention to provide a dimensional rigid means for mounting a retaining element within a shaft of a weaving machine.

It is another object of the invention to provide an element of relatively simple construction for mounting a retaining element within a shaft of a weaving machine.

It is another object of the invention to provide an arrangement for changing the relative position of a retaining element within a shaft of a weaving machine in a reliable manner.

Briefly, the invention is directed to a combination of a shaft, a retaining element and an intermediate element for securing the retaining element within the shaft. The shaft is constructed with a pair of longitudinally disposed sidewalls, at least one cross-bar interconnecting the walls to define an enclosed space and a bore in at least one sidewall. The retaining element extends from the enclosed space of the shaft so as to carry another item in a suspended manner and has an aperture disposed within the enclosed space to receive the intermediate element. The intermediate element includes a first inner member which is rotatably mounted in a bore of at least one of the sidewalls of the shaft and extends through the retaining element as well as a second ring shaped member which is disposed about the inner member within the aperture of the retaining element for rotation with the inner member. This second member also has an eccentric outer surface in engagement with the retaining element.

Since the intermediate element is a two piece element, the eccentric ring shaped member can first be introduced into the retaining element before assembly and then introduced together with the retaining element into the shaft and moved into a required position relative to the bore in the sidewall. The inner member can then be introduced through the bore into the eccentric member and retaining element. As a result, the eccentric member can be considerably larger than the bore in the shaft sidewall since the member does not have to be introduced through the bore. Further, the eccentric ring shaped member can be made of a harder material than the inner member. Consequently, the items to be secured to the retaining element can be located accurately.

The intermediate element retains the advantage of quiet suspension and adjustment while also facilitating assembly.

These and other objects and advantages of the invention will become more apparent from the following detailed description and appended claims taken in conjunction with the accompanying drawings in which:

Figure 3:
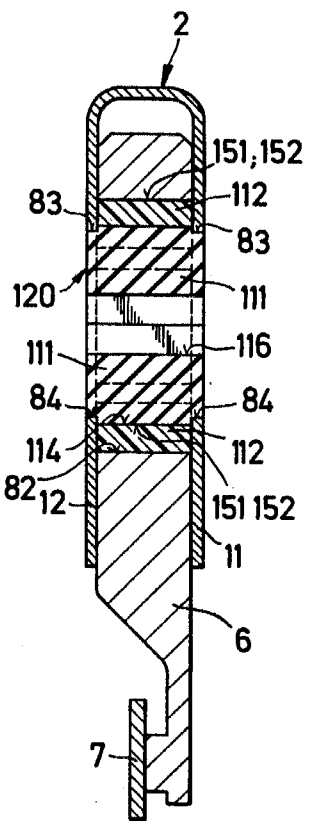
FIG. 3 illustrates a view taken on line A—A of FIGS. 1 and 2.
Figure 2:
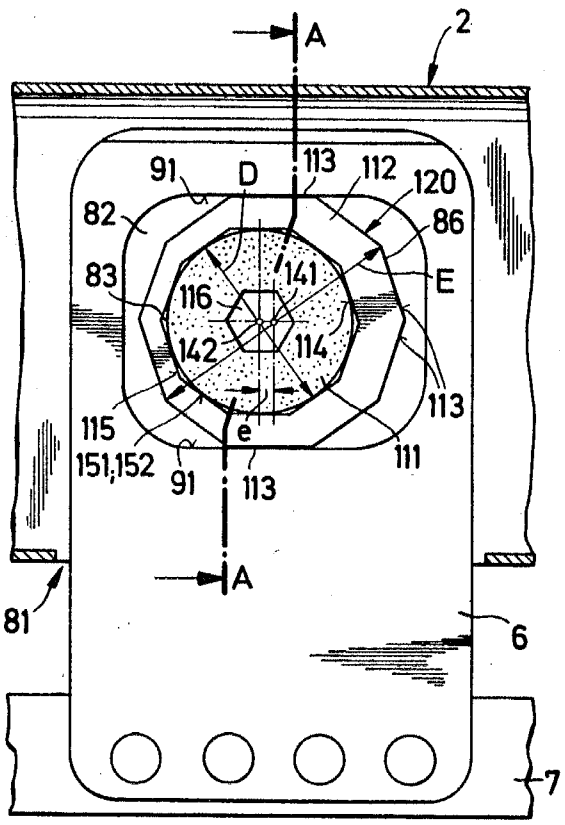
FIG. 2 illustrates a view similar to FIG. 1 but with a sidewall of the shaft removed.
Figure 1:
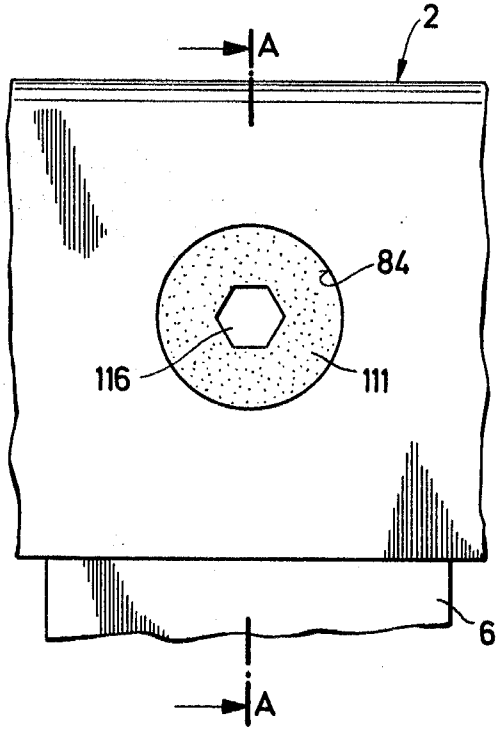
FIG. 1 illustrates a front view of a part of a shaft constructed in accordance with the invention.

Referring to FIGS. 1 to 3, the shaft 2 (beam) is of elongated shape and is made of known construction, for example as described in U.S. Pat. No. 3,696,842. To this end, the shaft 2 includes an upper longitudinal cross-bar which interconnects a pair of longitudinally disposed and opposed sidewalls 11, 12 which define an enclosed space. As shown in FIG. 2, the shaft 2 has a bottom wall which also interconnects the sidewalls 11, 12 and is provided with one or more apertures 81. Each sidewall 11, 12 is provided with a bore 84 (FIG. 1) for purposes as described below.

A retaining element 6 extends from within the enclosed space of the shaft 2 through the aperture 81 and serves as a support, for example to suspend a heedle lath 7 from the shaft 2. The retaining element 6 has an aperture 82 (FIG. 2) disposed within the enclosed space of the shaft 2 in alignment with the bores 84 in the sidewalls 11, 12. As shown, the aperture is of generally rectangular shape with four flat surfaces 91.

In order to secure the retaining element 6 within the shaft 2, an intermediate element 120 is mounted in the aperture 82 of the retaining element 6 and received in the bores 84 in the sidewalls 11, 12. This intermediate element 120 includes two members 111, 112 which are made of a resilient material with the outer member 112 being made of a harder material than the inner member 111. For example, the inner member 111 is made of rubber and the outer member is made of polyacetyl (POM-polyoxymethylene).

The inner member 111 has a pair of oppositely directed shoulders 83, each of which has a circular periphery which are rotatably received within a corresponding bore 84 of a sidewall 11, 12 of the shaft 2. In addition, the inner member 111 has a polygonal central bore 116, for example of hexagonal shape, and a polygonal outer periphery 151, for example of decagonal shape so as to provide ten flat surfaces 115 (see FIG. 2). The inner member 111 is disposed on an axis 142 and extends through the retaining element 6.

The outer member 112 is a ring shaped member which is disposed about the inner member 111 for rotation with the inner member 111. In addition, the outer member 112 has an eccentric outer surface or periphery 86 of polygonal shape, for example of decagonal shape so as to provide ten flat surfaces 113 about an axis 141. The outer member 112 also has an inner periphery 152 of polygonal shape to form for example ten inner surfaces 114 about the axis 142 which is eccentric to the axis 141 by an ecentricity e.

The intermediate element 120 is constructed such that the outer surfaces 115 of the inner member 111 have an exact fit with the inner peripheral surfaces 114 of the eccentric outer member 112.

In order to assemble the above described structure, the retaining element 6 is first pushed onto the ring shaped member 112 such that the member 112 is received within the aperture 82 with two opposed surfaces 113 in mating engagement with two opposed surfaces 91 of the aperture 82 (FIG. 2). Next, the retaining element 6 with the member 112 is introduced into the shaft 2 through the aperture 81 and the member 112 is aligned with the bores 84. Thereafter, the inner member 111 is introduced into the ring shaped member 112 via one of the bores 84. Because of the resiliency of the inner member 111 and the central bore 116, the member 111 is able to compress radially inwardly so as to fit through the bore 84 and be fitted within the ring shaped member 112. The polygonal periphery 151 of the inner member 111 is then clamped between the walls 11, 12 while the shoulders 83 are journalled within the bores 84 of the walls 11, 12.

As indicated in FIG. 3, the shoulders 83 and the periphery 151 of the inner member 111 are concentric.

In order to make an adjustment in the distance between the supported heedle lath 7 and the shaft 2, a hexagonal box spanner (not shown) may be inserted into the aperture 116 of the inner member 111 and rotated. This causes the inner member 111 as well as the outer member 112 to rotate within the retaining element 6 and shaft 2 with both members 111, 112 experiencing a resilient deformation. Since the outer member 112 is made of a hard resilient plastics, despite the large number of outer surfaces 113, a "click" which can be clearly perceived during manual rotation occurs and the system remains stable in whatever position the element 120 is rotated to. For the ten surfaces 113 shown, the lath 7 (and the retaining element 6) can be adjusted in the five steps with each step corresponding to approximately 40% of the eccentricity e.

Figure 4:
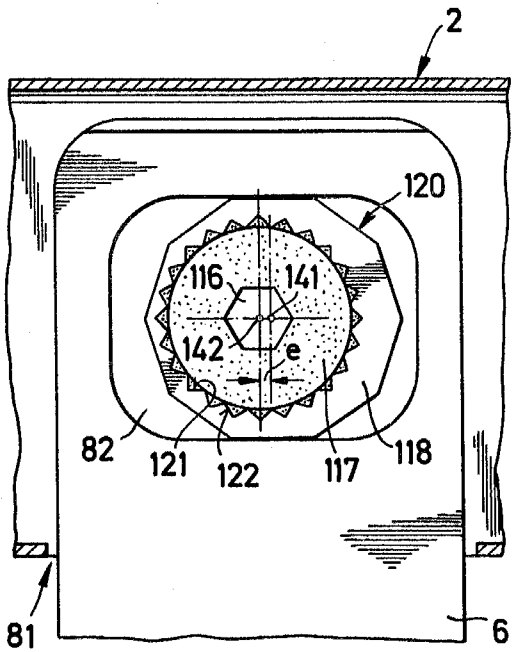
FIG. 4 illustrates a view of a modified intermediate element according to the invention.

Referring to FIG. 4, wherein like reference characters indicate like parts as above, the resilient intermediate element 120 may be in the form of two members 117, 118 which have mating peripheries of toothed shape. As illustrated, the outer eccentric member 118 has a toothing 121 on the inner periphery which matches a toothing 122 on the outer periphery of the inner member 117. The toothing arrangement insures that the two members 117, 118 rotate in fixed relation with each other.

Figure 6:
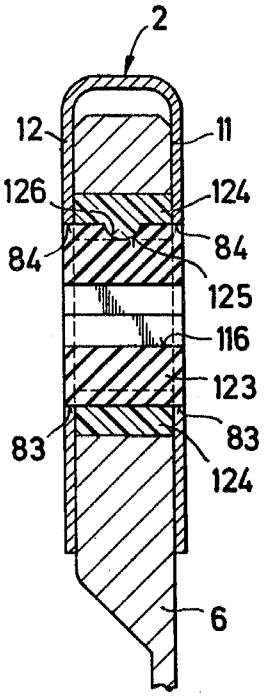
FIG. 6 illustrates a view taken on line B—B of FIG. 5.
Figure 5:
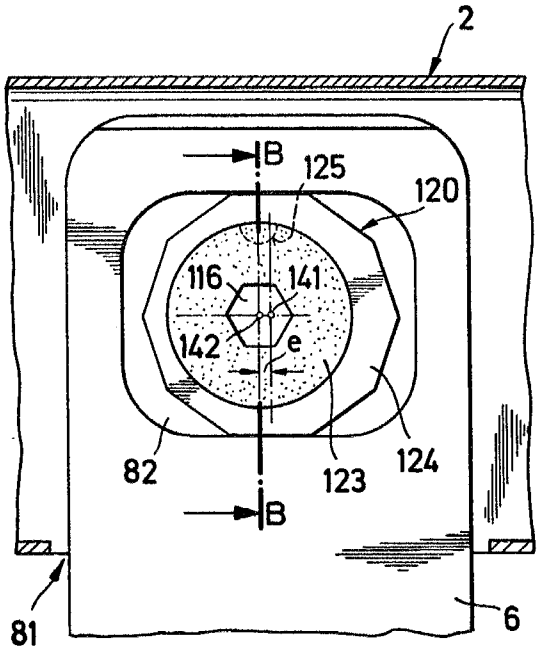
FIG. 5 illustrates a further modified intermediate element according to the invention.

Referring to FIGS. 5 and 6, wherein like reference characters indicate like parts as above, the resilient intermediate element 120 may alternatively be constructed such that the inner member 123 has a circular periphery. In this case, the opposite ends of the inner member 123 serve as shoulders 83 for rotation in the bores 84 of the sidewalls 11, 12 of the shaft. In order to secure the outer eccentric member 124 to the inner member 123, use is made of at least one projection 125 on the inside surface of the outer member 124 and a mating recess 126 in the outer surface of the inner member 123. During assembly, the projection 125 is able to snap into the recess 126 to insure that the inner member 123 is located axially with respect to the outer member as well as being secured against rotation.

Figure 8:
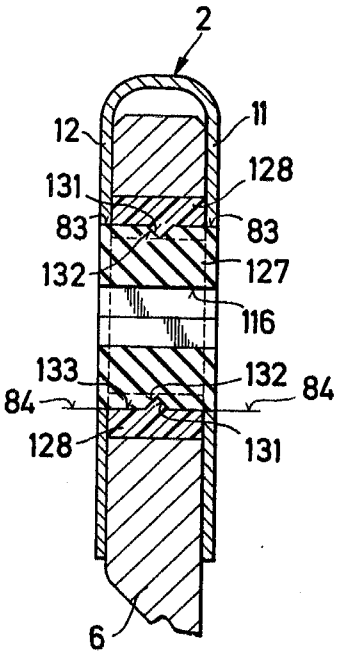
FIG. 8 illustrates a view taken on line C—C of FIG. 7.
Figure 7:
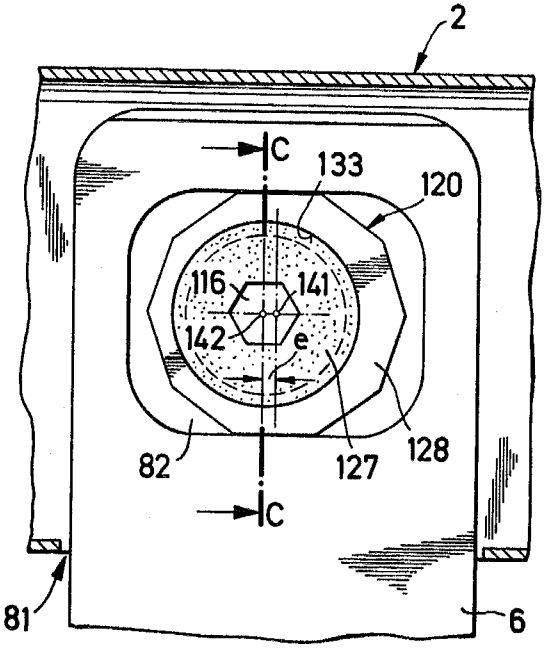
FIG. 7 illustrates a view of a further modified intermediate element according to the invention.

Referring to FIGS. 7 and 8, wherein like reference characters indicate like parts as above, the intermediate element 120 may alternatively be constructed such that the inner member 127 and outer eccentric member 128 are adhesively secured to each other by a suitable adhesive. In addition, for additional axial location, the inner member 127 is formed with a recess, such as a groove 131, in the outer surface while a corresponding projection, such as an annular protuberance 132, is provided on the inside surface 133 of the member 128.

It is to be noted that the outer member 112 of the intermediate element 120, for example of FIGS. 1–3, can be circular while the aperture 91 of the retaining element 6 is also circular. In this case, the intermediate element 120 is secured to the retaining element 6 purely by friction or clamping.

What is claimed is:

1. In combination, a shaft having a pair of longitudinally disposed opposed side walls and at least one cross bar interconnecting said walls to define an enclosed space;

a retaining element extending from said space of said shaft and having an aperture therein disposed within said space; and an intermediate element securing said retaining element in said shaft between said walls, said intermediate element including a first inner member rotatably mounted in at least one of said walls of said shaft and extending through said retaining element and a second ring shaped member disposed about said inner member within said aperture of said retaining element for rotation with said inner member, said second member having an eccentric outer surface in engagement with said retaining element.

2. The combination as set forth in claim 1 wherein said eccentric outer surface has a polygonal shape and said retaining element has at least one straight surface defining said aperture and engaging said outer surface of said second member.

3. The combination as set forth in claim 1 wherein said inner member has a pair of oppositely directed shoulders, each said shoulder being disposed in a respective one of said walls of said shaft.

4. The combination as set forth in claim 1 wherein said first member has a polygonal outer periphery and said second member has a polygonal inner periphery in mating engagement with said periphery of said first member.

5. The combination as set forth in claim 1 wherein said members each have a toothing engaging a toothing of the other member to secure said members together for rotation.

6. The combination as set forth in claim 1 wherein one of said members has a recess and the other of said members has a projection disposed in said recess to secure said members together against one of rotation and axial movement.

7. The combination as set forth in claim 1 wherein said members are adhesively secured to each other.

8. The combination as set forth in claim 1 wherein said second member is made of a harder material than said first member.

9. The combination as set forth in claim 8 wherein said second member is made of polyacetal and said inner member is made of rubber.

10. An element for securing a retaining element to a shaft of a weaving machine, said element comprising a first resilient inner member having at least one circular peripheral surface and a polygonal outer periphery; and a second resilient ring shaped member disposed eccentrically about said first inner member, said second member being of a harder material than said inner member and having an eccentric outer surface and a polygonal inner periphery in mating engagement with said outer periphery of said inner member.

11. An element as set forth in claim 10 wherein said inner member has a pair of oppositely directed shoulders, each said shoulder defining a circular peripheral surface.

12. An element as set forth in claim 10 wherein said inner member is made of rubber and said second member is made of polyacetal.

13. An element as set forth in claim 10 wherein said mating peripheries are tooth-shaped.

14. An element for securing a retaining element to a shaft of a weaving machine, said element comprising a first resilient inner member having an outer circular peripheral surface; and a second resilient ring shaped member disposed eccentrically about said first member, said second member being of a harder material than said inner member and having an eccentric polygonal outer surface;

one of said members having a recess and the other of said members having a projection disposed in said recess to secure said members together against one of rotation and axial movement.

15. In combination, a shaft for a weaving machine having a pair of longitudinally disposed opposed side walls and at least one cross bar interconnecting said walls to define an enclosed space, at least one of said side walls having a bore therein;

a retaining element extending from said space of said shaft and having an aperture of generally rectangular shape therein disposed within said space; and an intermediate element securing said retaining element in said shaft between said walls, said intermediate element including a first inner member rotatably mounted in said bore of said one wall of said shaft and extending through said retaining element and a second ring shaped member disposed about said inner member within said aperture of said retaining element for rotation with said inner member, said second member being of a harder material than said first member and having an eccentric polygonal-shaped outer surface in engagement with at least one straight surface of said aperture of said retaining element.

* * * * *